US009875608B1

(12) United States Patent
Drozd et al.

(10) Patent No.: US 9,875,608 B1
(45) Date of Patent: Jan. 23, 2018

(54) SPORTS-WAGERING KIOSK AND METHOD OF USING AND OPERATING THE SAME

(71) Applicant: American Wagering, Inc., Las Vegas, NV (US)

(72) Inventors: Sandra Drozd, Las Vegas, NV (US); Ronald Tabat, Las Vegas, NV (US); Sean Cronan, Las Vegas, NV (US)

(73) Assignee: American Wagering, Inc., Las Vegas, NV (US)

( * ) Notice: Subject to any disclaimer, the term of this patent is extended or adjusted under 35 U.S.C. 154(b) by 243 days.

(21) Appl. No.: 14/488,234

(22) Filed: Sep. 16, 2014

(51) Int. Cl.
*A63F 9/24* (2006.01)
*G07F 17/32* (2006.01)

(52) U.S. Cl.
CPC ..... *G07F 17/3241* (2013.01)

(58) Field of Classification Search
CPC ..... G07F 17/3237; G07F 17/3206; G07F 17/3241
See application file for complete search history.

(56) References Cited

U.S. PATENT DOCUMENTS 6,709,333 B1 3/2004 Bradford et al.
6,712,698 B2 3/2004 Paulsen et al.
6,896,618 B2 5/2005 Benoy et al.
7,039,221 B1 * 5/2006 Tumey ..... G06K 9/00221 382/118
7,603,321 B2 10/2009 Gurvey
7,828,646 B2 11/2010 Franks, Jr.
9,240,098 B2 1/2016 Williams et al.
9,269,224 B2 2/2016 Williams et al.
9,305,429 B2 4/2016 Skelton et al.
2001/0026632 A1 * 10/2001 Tamai ..... G06K 9/00 382/116
2002/0151340 A1 10/2002 Guinn et al.
2004/0052403 A1 * 3/2004 Houvener ..... G07C 9/00087 382/115
2004/0240711 A1 * 12/2004 Hamza ..... G06K 9/00201 382/118
2006/0019742 A1 1/2006 Reeves
2006/0019746 A1 1/2006 Seelig et al.
2007/0082740 A1 4/2007 Stearns et al.
(Continued)

OTHER PUBLICATIONS

US 9,262,888, 02/2016, Skelton et al. (withdrawn)

*Primary Examiner* — Steve Rowland
(74) *Attorney, Agent, or Firm* — Armstrong Teasdale LLP

(57) ABSTRACT

A sports-wagering kiosk including at least a (i) display; (ii) identification card reader; (iii) camera; (iv) processing means; (v) printer; (vi) ticket reader; (vii) bill validator; and (viii) communication link for communicating with a central computer system. The sports-wagering kiosk facilitates a registration and wagering process by: (i) capturing an image of a prospective player; (ii) reading data from an identification card including a photograph; (iii) verifying an age of the prospective player and validity of the identification card based on reading the data therefrom; (iv) transmitting at least some of the data read from the identification card to a central computer system; (v) verifying the identification of the prospective player by comparing the captured photograph to a photograph on the identification card; (vi) once the identification is verified, prompting the prospective player to enter a password; and (vii) printing a receipt with player account information.

18 Claims, 23 Drawing Sheets

(56) References Cited

U.S. PATENT DOCUMENTS

| | | | | |
|---|---|---|---|---|
| 2007/0252001 | A1* | 11/2007 | Kail | G07C 9/00087 235/380 |
| 2011/0124405 | A1* | 5/2011 | Okada | G07D 7/002 463/25 |
| 2013/0084933 | A1 | 4/2013 | Amaitis et al. | |
| 2014/0256423 | A1* | 9/2014 | Williams | G07F 17/3241 463/29 |
| 2014/0256425 | A1 | 9/2014 | Flaherty | |
| 2014/0302915 | A1 | 10/2014 | Lyons et al. | |
| 2015/0169946 | A1* | 6/2015 | Needleman | G06K 9/00295 382/118 |
| 2016/0133092 | A1 | 5/2016 | Williams et al. | |

* cited by examiner

415

402

405

430

435

440

445

406

515

520

501

510

625

602

620

SPORTS-WAGERING KIOSK AND METHOD OF USING AND OPERATING THE SAME

FIELD OF THE INVENTION

The embodiments of the present invention relate to a sports-wagering kiosk configured to register players, accept wagers and payout winnings into player accounts.

BACKGROUND

Sports wagering is legal in only three states within the United States. However, Nevada is the only state with a full range of legalized sports wagering. To that end, Nevada has sports books in many casinos throughout the state. In Nevada, wagers on sporting events can be made at a sports book counter, online via known mobile applications and kiosks. However, current kiosks suffer from various drawbacks.

It would be advantageous to develop a sports-wagering kiosk which overcomes the drawbacks of the current sports-wagering kiosks.

SUMMARY

Accordingly, one embodiment of the present invention comprises a kiosk comprising at least a (i) display; (ii) identification card reader; (iii) camera; (iv) processing means; (v) printer; (vi) ticket/voucher validator; (vii) bill validator; and (viii) communication link for communicating with a central computer system. Additional components, such as internal power, may be integrated into the kiosk as well. A series of kiosks communicatively linked to a central computer forms a network of kiosks.

In practice, the kiosk facilitates a process of registering for a wagering account by: (i) capturing a live picture of a prospective player; (ii) reading information from an identification card including name, address, date of birth and a photograph; (iii) verifying an age of said prospective player and validity of said identification card based on collecting said data information from an identification card including a photograph; (iv) transmitting at least some of said information read from said identification card to a central computer system; (v) verifying the identification of the prospective player by comparing the captured live picture to said photograph on said identification card; (vi) once said identification is verified, prompting said prospective player to create a password; and (vii) printing a receipt with player account information.

Other variations, embodiments and features of the present invention will become evident from the following detailed description, drawings and claims.

DETAILED DESCRIPTION

Figure 1:
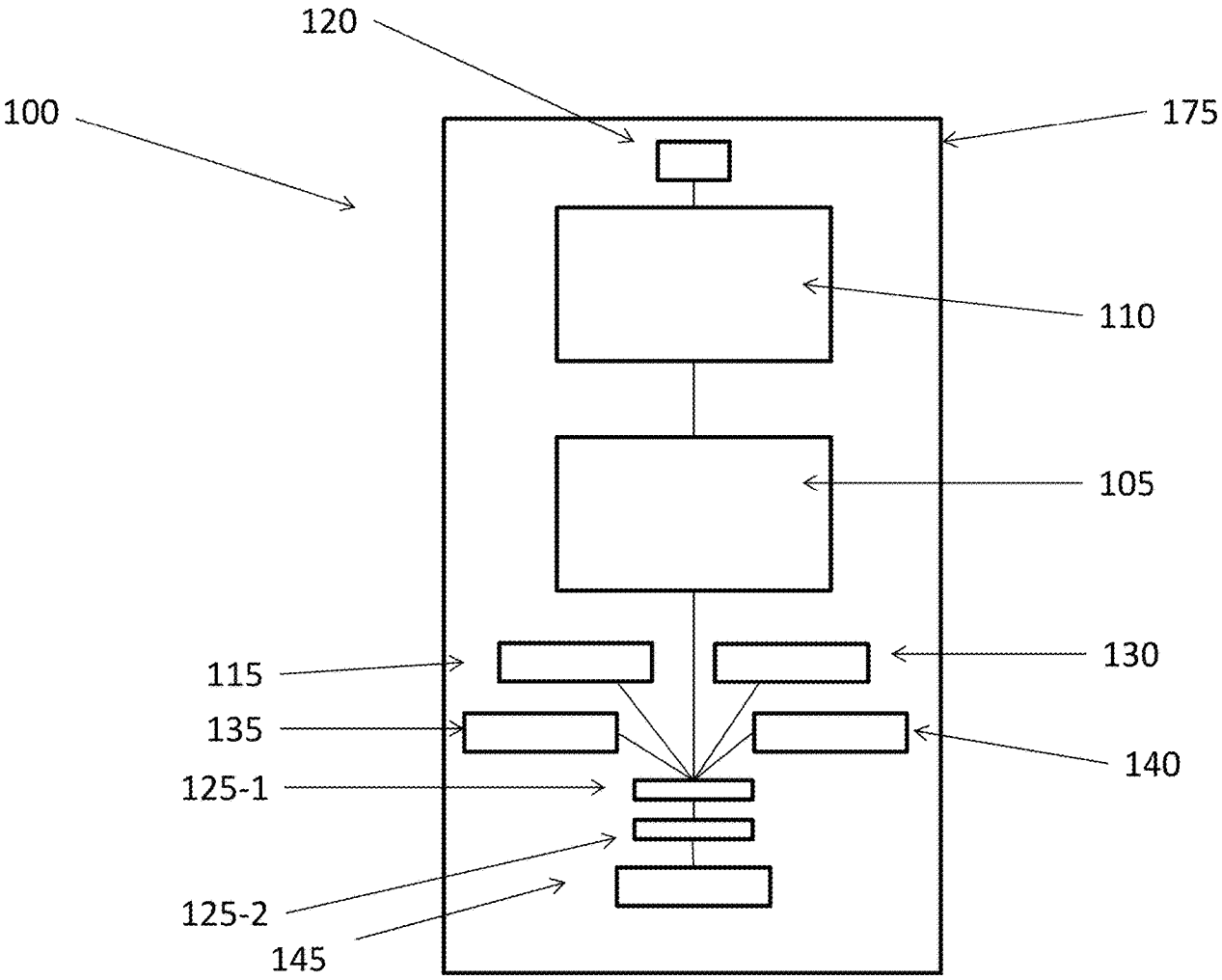
FIG. 1 illustrates a block diagram of a kiosk according to the embodiments of the present invention.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

Those skilled in the art will recognize that the embodiments of the present invention involve both hardware and software elements which portions are described below in such detail required to construct and operate a sports-wagering kiosk according to the embodiments of the present invention.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.), or an embodiment combining software and hardware. Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), and optical storage device, a magnetic storage device, or any suitable combination of the foregoing. In the context of this document, a computer readable storage medium may be any tangible medium that can contain or store a program for use by or in connection with an instruction execution system, apparatus, or device.

A computer readable signal medium may include a propagated data signal with computer readable program code embodied thereon, for example, in baseband or as part of a carrier wave. Such a propagated signal may take any variety of forms, including, but not limited to, electromagnetic, optical, or any suitable combination thereof. A computer readable signal medium may be any computer readable medium that is not a computer readable storage medium and that can communicate, propagate, or transport a program for use by or in conjunction with an instruction execution system, apparatus, or device.

Program code embodied on a computer readable medium may be transmitted using any appropriate medium, including but not limited to wireless, wireline, optical fiber cable, RF and the like, or any suitable combination of the foregoing.

Computer program code for carrying out operations for aspects of the present invention may be written in any combination of one or more programming languages, including an object oriented programming language such as Java, Smalltalk, C++ or the like or conventional procedural programming languages, such as the "C" programming language, AJAX, PHP, HTML, XHTML, Ruby, CSS or similar programming languages. The programming code may be configured in an application, an operating system, as part of a system firmware, or any suitable combination thereof. The programming code may execute entirely on the user's computer, partly on the user's computer, as a stand-alone software package, partly on the user's computer and partly on a remote computer or entirely on a remote computer or server as in a client/server relationship sometimes known as cloud computing. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer-implemented process such that the instructions which execute on the computer or other programmable apparatus provide processes for implementing the functions/acts specified in the flowchart and/or block diagram block or blocks. As used herein, a "terminal" should be understood to be any one of a general purpose computer, as for example a personal computer or a laptop computer, a client computer configured for interaction with a server, a special purpose computer such as a server, or a smart phone, soft phone, tablet computer, personal digital assistant or any other machine adapted for executing programmable instructions in accordance with the description thereof set forth above.

FIG. 1 shows a block diagram of a sports-wagering kiosk 100 according to the embodiments of the present invention. The sports-wagering kiosk 100 comprises a user display 105, information display 110, identification card reader 115, camera 120, processing means 125, printer 130, ticket/voucher validator 135, bill validator 140 and communication link 145 for communicating with a central computer system 150. The processing means 125 can be a processor or controller or similar programmable hardware and/or software device. The processing means 125 controls the operation of the sports-wagering kiosk 100 and more specifically the displays 105, 110, identification card reader 115, camera 120, printer 130, ticket/voucher validator 135, bill validator 140 and communication link 145 for communicating with a central computer system 150. In one embodiment, the sports-wagering kiosk 100 includes two processors comprising a first processor 125-1 for controlling the acceptance of sports bets and the account sign-up process and a second processor 125-2 for driving the display 110. The communication link 145 between the sports-wagering kiosk 100 and central computer system 150 may be a wireless system comprising a modem and router, a cellular network, wireless WAN or the like. A wired connection (e.g., cable, fiber optics, etc.) may also be used as the communication link 145 between the sports-wagering kiosk 100 and central computer system 150. One specific embodiment utilizes a first network card installed in the processor 125-1 and a second network card installed in the processor 125-2 wherein the two processors 125-1 and 125-2 are cabled to a network switch connected to a sports book network allowing communications to the central, remote and/or backend systems. The importance of the communication link 145 is described below in detail.

In one embodiment, the display 105 integrates touch screen technology rendering the display 105 a user interface through which the player may interact with the sports-wagering kiosk 100. The user interface may also be in the form of a keyboard, mouse, button panel, track ball and/or joystick. For purposes of describing the sports-wagering kiosk 100 herein, it will be assumed the user interface is the display 105 integrating touch screen technology. Display 110 provides sports wagering data including, for example, current odds and start times and associated with various sporting events. The display 110 may incorporate touch screen technology allowing players to scroll through sporting events. Alternatively, other user interfaces such as buttons or the likes may be integrated into the kiosk 100.

Figure 2:
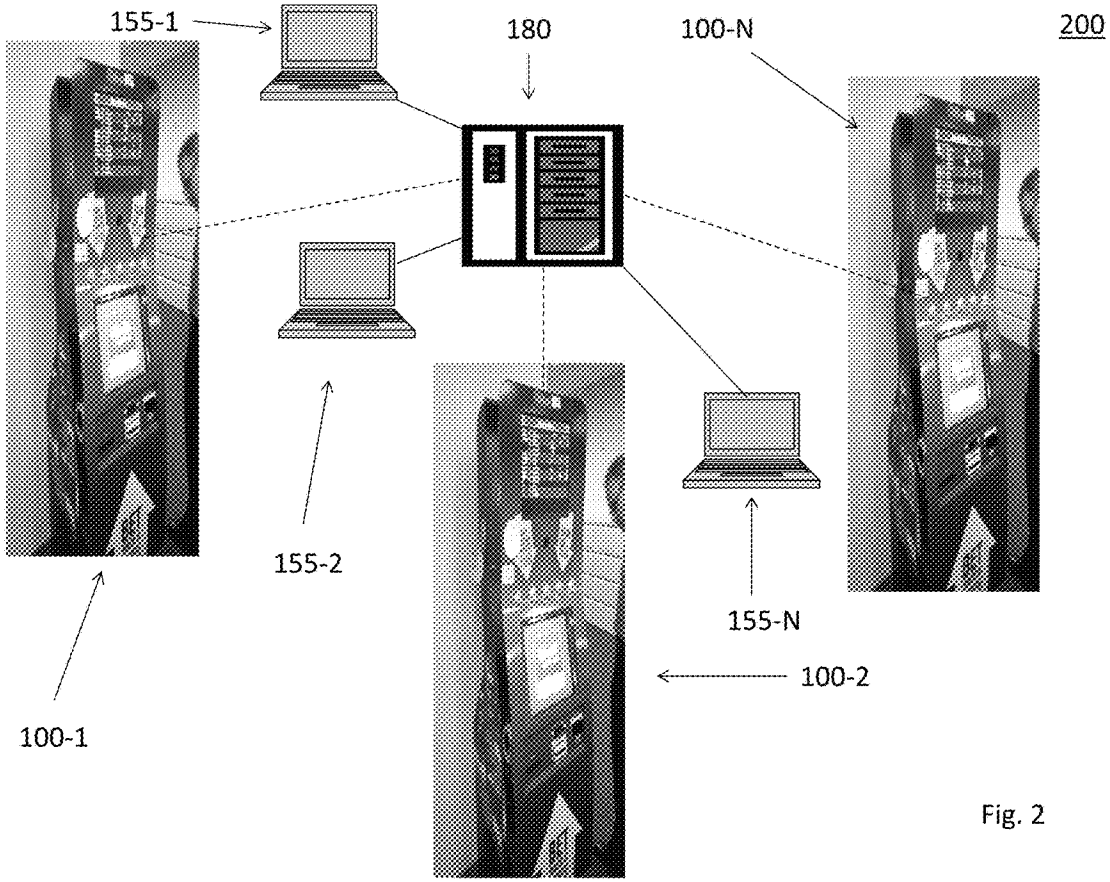
FIG. 2 illustrates a block diagram of a kiosk network according to the embodiments of the present invention.

FIG. 2 shows a block diagram of a kiosk network 200 according to the embodiments of the present invention. A plurality of sports-wagering kiosks 100-1 through 100-N are in wired and/or wireless communication with a central computer server 180. Terminals 155-1 through 155-N are configured to permit backend user communications with the central computer server 180 and related hardware. The central computer server 180 and terminals 155-1 through 155-N broadly define the central computer system 150. In another embodiment, the central computer system 150 comprises a first primary server (Sports Book Server) configured to handle the sports betting aspects of the present invention and a second server (i.e., Face Server) configured to handle storage of the images of the player and approve new wagering applications (e.g., compare driver license picture to the actual photograph of the player, etc.). Other hardware, such as a database server, internet server and/or website server, and associated software may form part of the central computer system 150. As described below, the central computer system 150 receives information from the sports-wagering kiosks 100-1 through 100-N and disseminates, or causes the dissemination of, information (e.g., real-time odds of sporting events) to the sports-wagering kiosks 100-1 through 100-N. In this sense, the communication link 145 is bi-directional.

As best shown in FIGS. 7A-7F, the sports-wagering kiosk 100 includes a housing 175 containing and protecting the aforementioned components and any others. Those skilled in the art will recognize that the housing 175 may take on other shapes, dimensions and/or forms. A modified housing may define a standalone device (as shown), wall-mounted device, wall-embedded device and the like. As set forth above, software and/or firmware assist with the operation of the sports-wagering kiosk 100 as detailed below. FIGS. 7A-7F show various views of one embodiment of the kiosk 100 and housing 175 which supports displays 105, 110, identification card reader 115, camera 120, receipt slot 131, ticket/voucher validator 135 and bill validator 140.

FIGS. 7C-7F best show the sports-wagering kiosk 100 in an open arrangement revealing internal components of the sports-wagering kiosk 100. As shown, a front face portion 176 of the housing 175 disengages from a primary body portion 177 of the housing 175 permitting access to the internal space defined by the housing 175. The front face portion 176 slides along tracks 178 creating separation from, while in contact with, the primary body portion 177. Advantageously, many of the components are maintained by the front face portion 176 thereby moving the components out of the primary body portion 177 of the housing 175 for easy access, inspection and/or repair.

Figure 3:
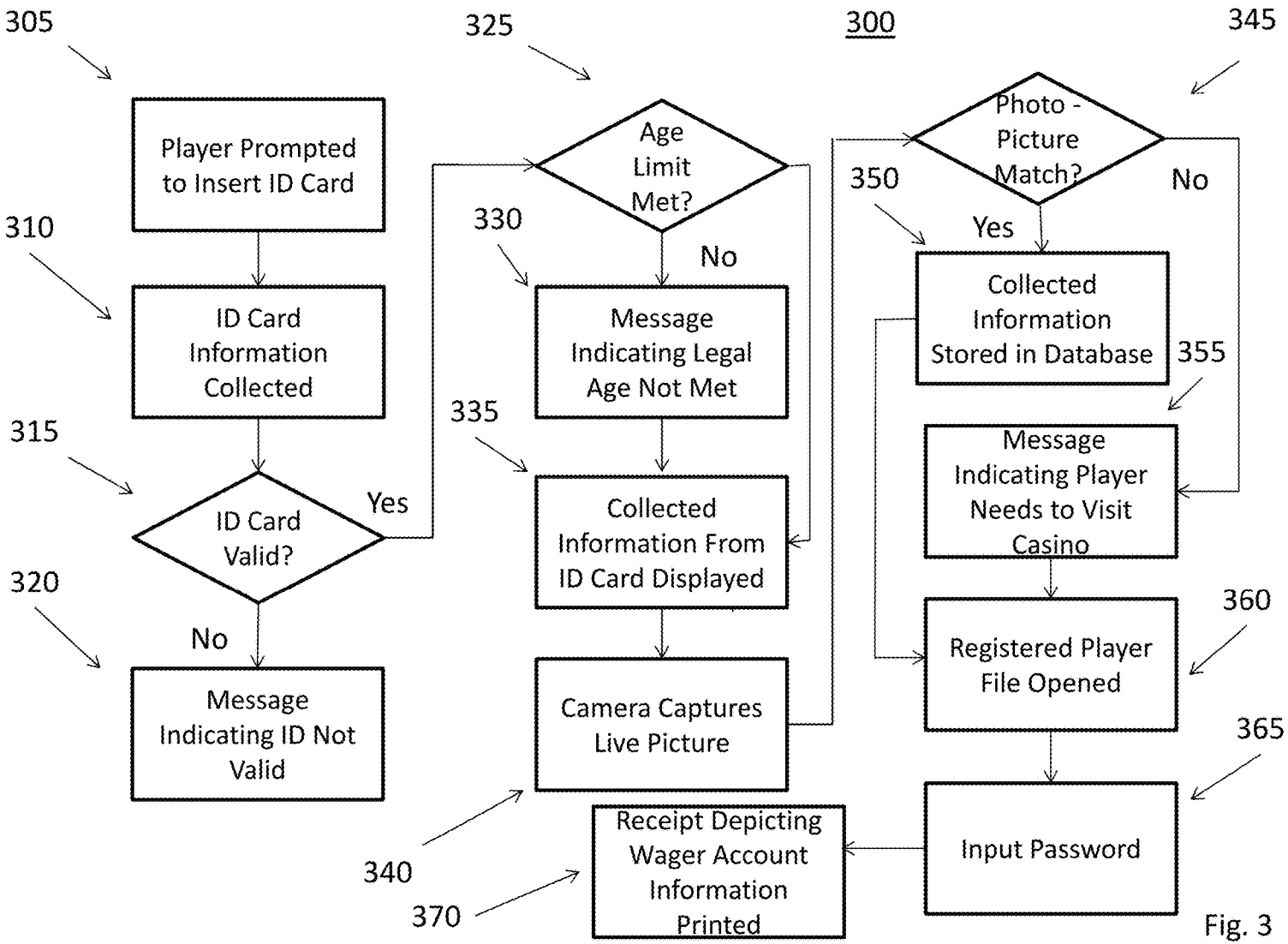
FIG. 3 illustrates a flow chart detailing an exemplary registration methodology facilitated by the kiosk according to the embodiments of the present invention.

FIG. 3 shows a flowchart 300 detailing a registration process facilitated by the sports-wagering kiosk 100 and central computer system 150. The registration process permits prospective players to register for a sports-wagering account after which the registered players may use the sports-wagering kiosk 100 to place wagers on sporting events and accept deposits and withdraws in the form of a voucher for subsequent redemption. At 305, a prospective player is prompted to insert a driver's license or identification card issued by a state government. At 310, the identification card reader 115 reads the magnetic stripe or uses OCR to collect the identification card information and capture the photograph. The identification card reader may also be configured to read rewards player cards and the like. At 315, the system determines if the identification card is valid as part of the automated account sign up process. This determination may be made locally at the kiosk or at the central computer system 150. If not, at 320, a message is displayed indicating that identification card not valid and the prospective player needs a valid identification card to register. At 325, the system determines if the prospective player is 21 years or older. This determination may be made locally at the kiosk or at the central computer system 150. If not, at 330, the system displays a message indicating that the prospective player is not of legal age to register. At 335, the information read or scanned from the identification card is displayed for confirmation and/or correction of the information and the prospective player is prompted to enter a social security number. At 340, the camera takes a live picture of the prospective player. A message may be displayed requesting the prospective player stand and face the camera or a point proximate thereto. At 345, the identification card photograph and live picture are transmitted from the central computer server 180 (or primary server as described above) to a terminal 155 for comparison by a human operator and/or software configured to do so. If necessary, the kiosk may prompt the prospective player for a second live picture due to poor quality of the first. Once a match is confirmed, at 350, the information from the identification card, social security number and live picture are stored in a database associated with the central computer system 150. If the identification card photograph and live picture are found to not match, at 355, a message is displayed indicating that the prospective player needs to visit a live registration location (e.g., casino) to complete the registration process. At 360, based on a match, a registered player file/wager account is opened on the central computer system 180 and corresponding databases are populated with the information collected from the identification card, social security number and live picture. In a two server embodiment, the live picture is stored on the second server ("Face Server"). At 365, a message is displayed prompting a prospective player to input a password via said user interface display 105. At 370, responsive to acceptance of the password, the kiosk printer 130 prints a ticket with registered player account information depicted thereon. Once registered, the player is able to utilize the kiosk to place wagers, access player account information, deposit money to fund said player account and print winning tickets redeemable at a casino cage or cash kiosk. In one embodiment, the registered player may also wager through a mobile wagering application associated with the operator of the kiosk network 200.

Figure 4A:
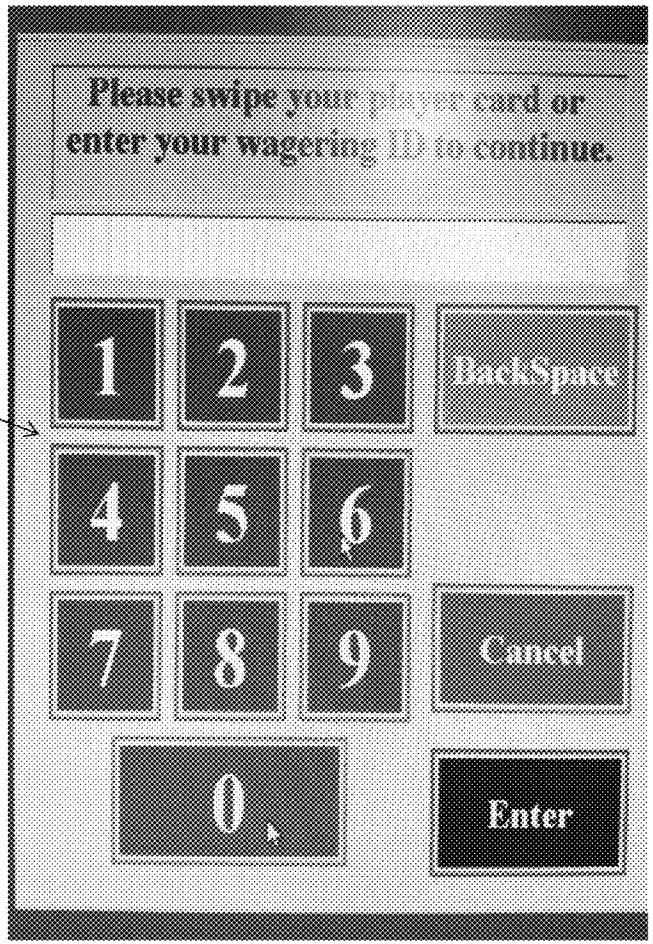
FIGS. 4A-4G illustrate a series of exemplary screen shots of a deposit process associated with the kiosk according to the embodiments of the present invention.
Figure 4B:
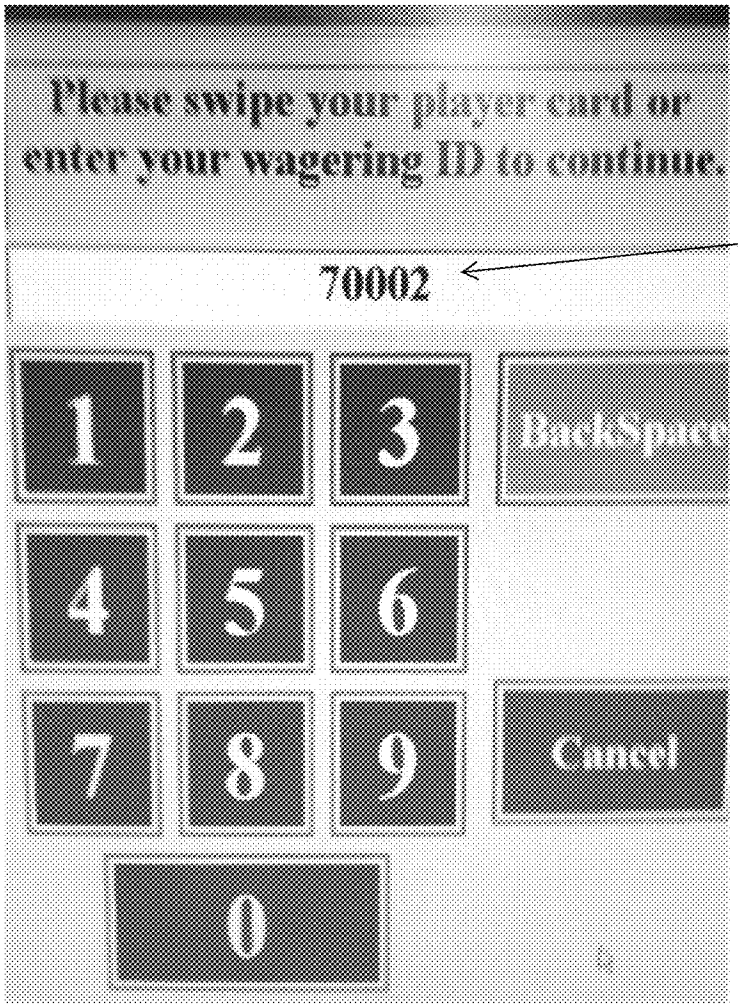
Figure 4C:
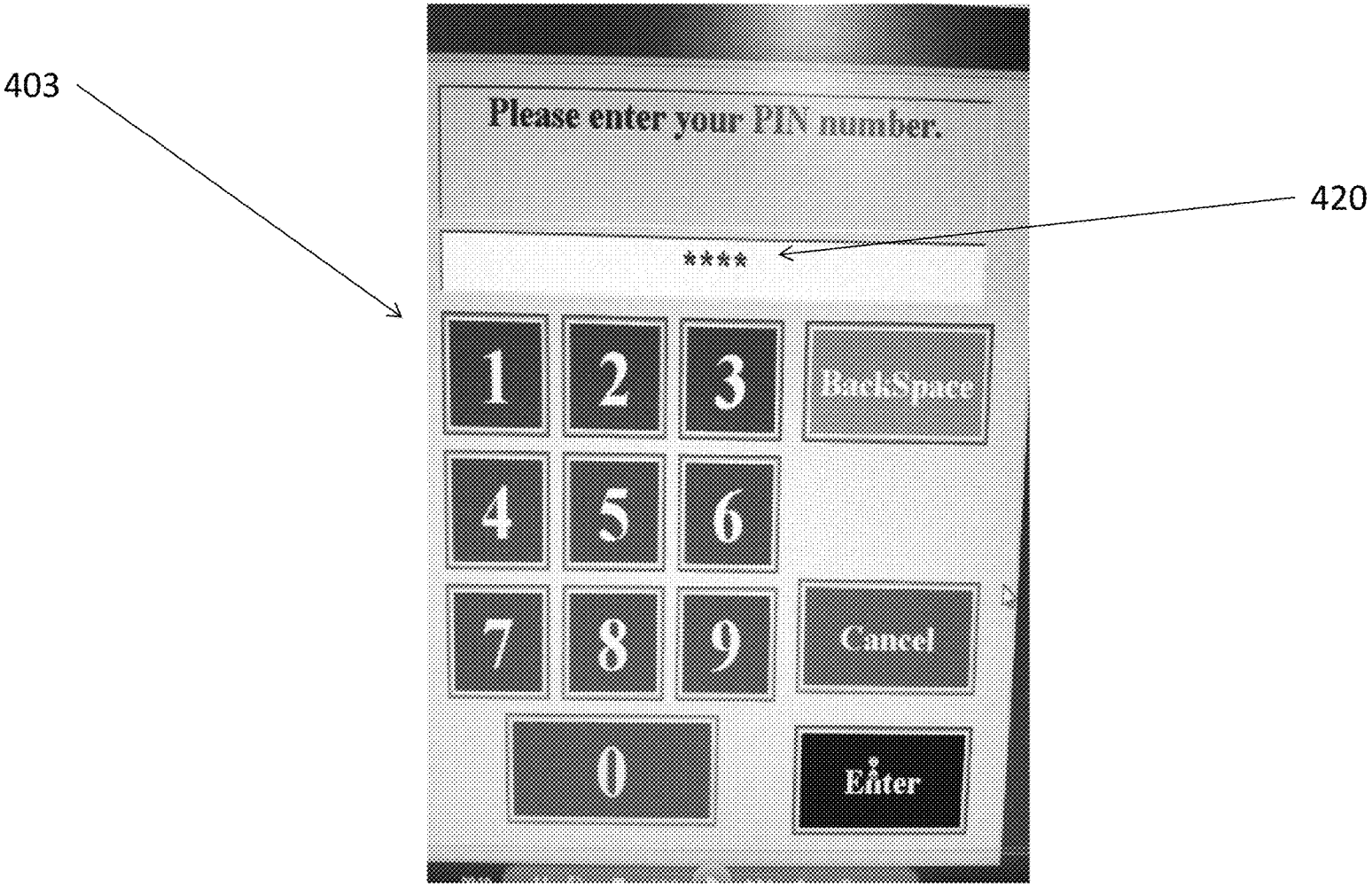
Figure 4D:
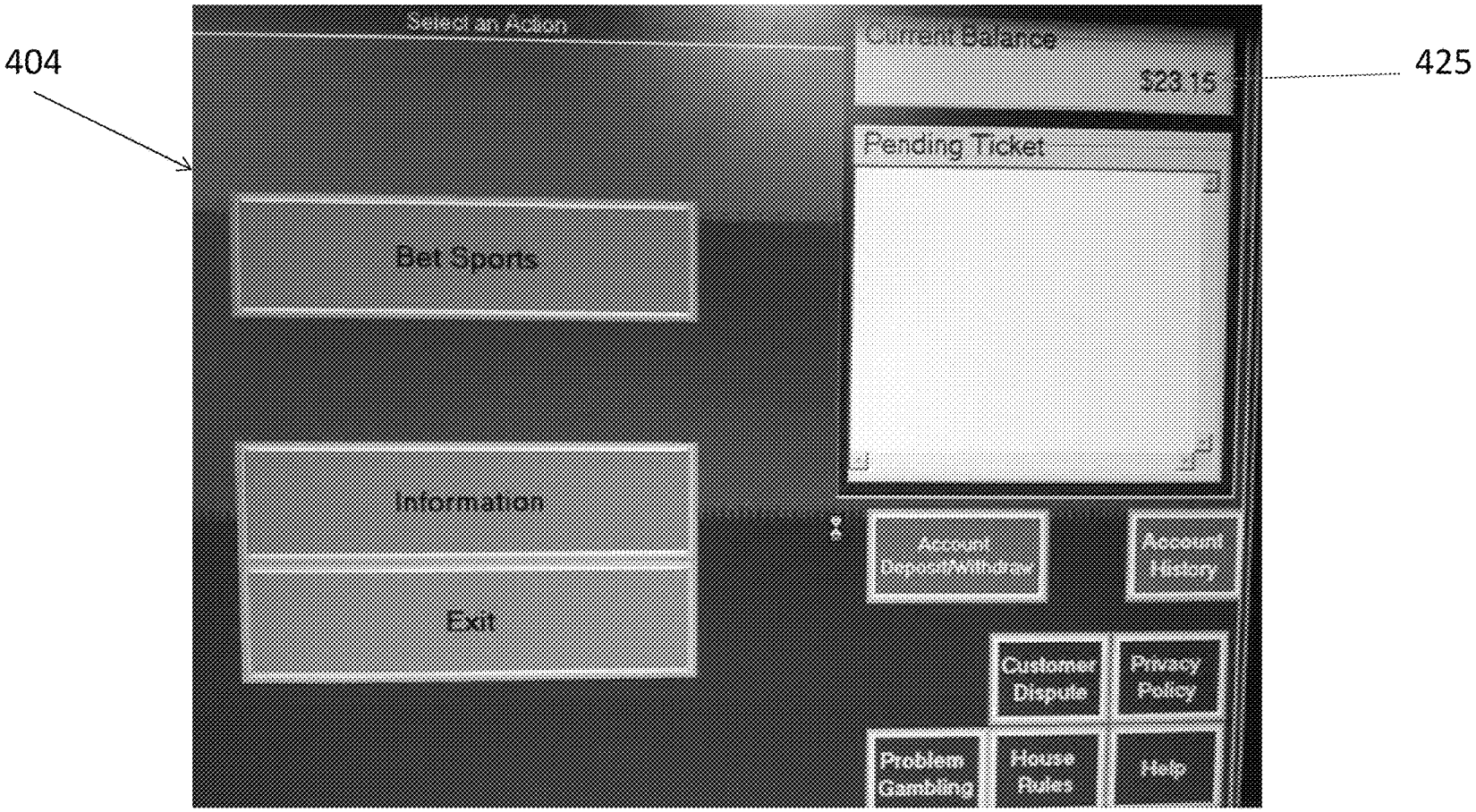
Figure 4E:
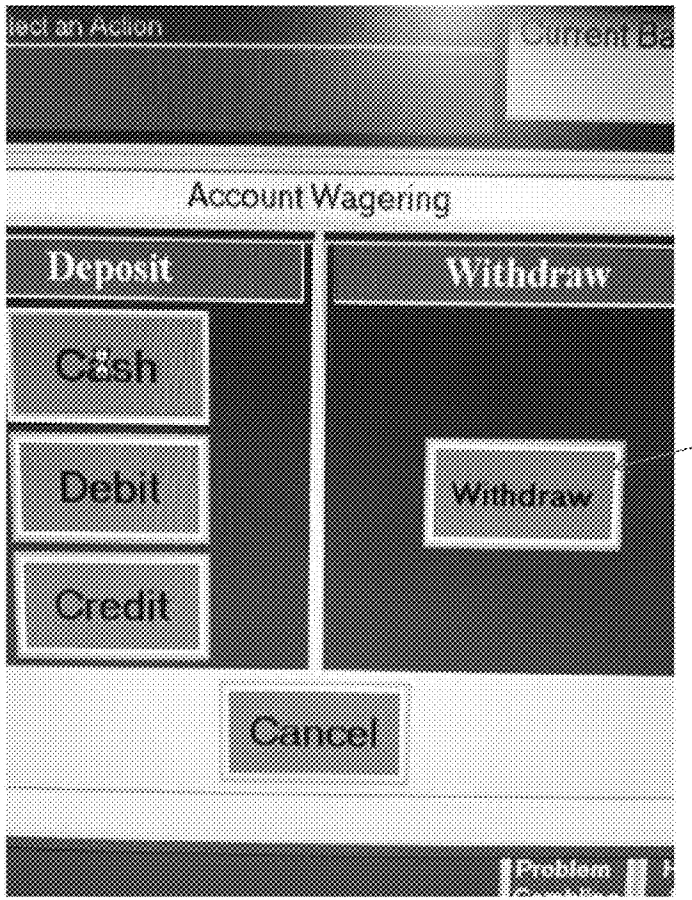
Figure 4F:
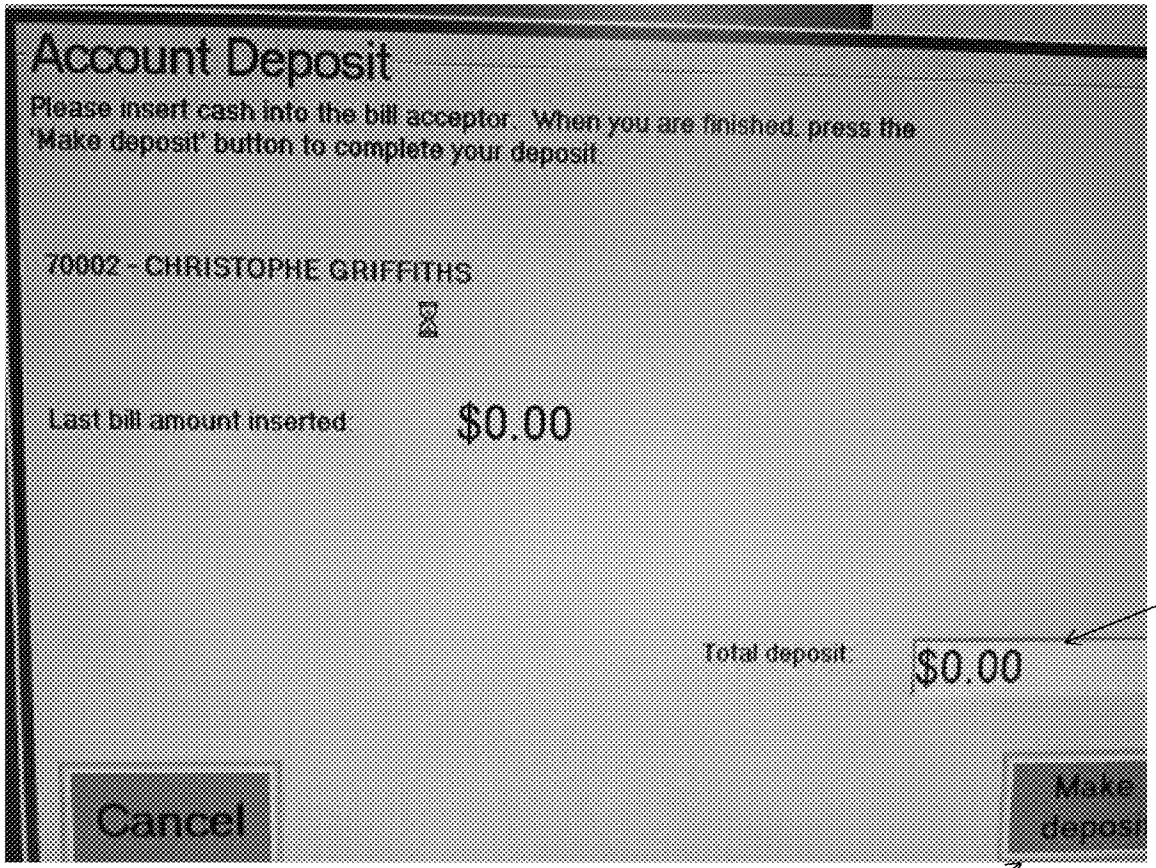
Figure 4G:
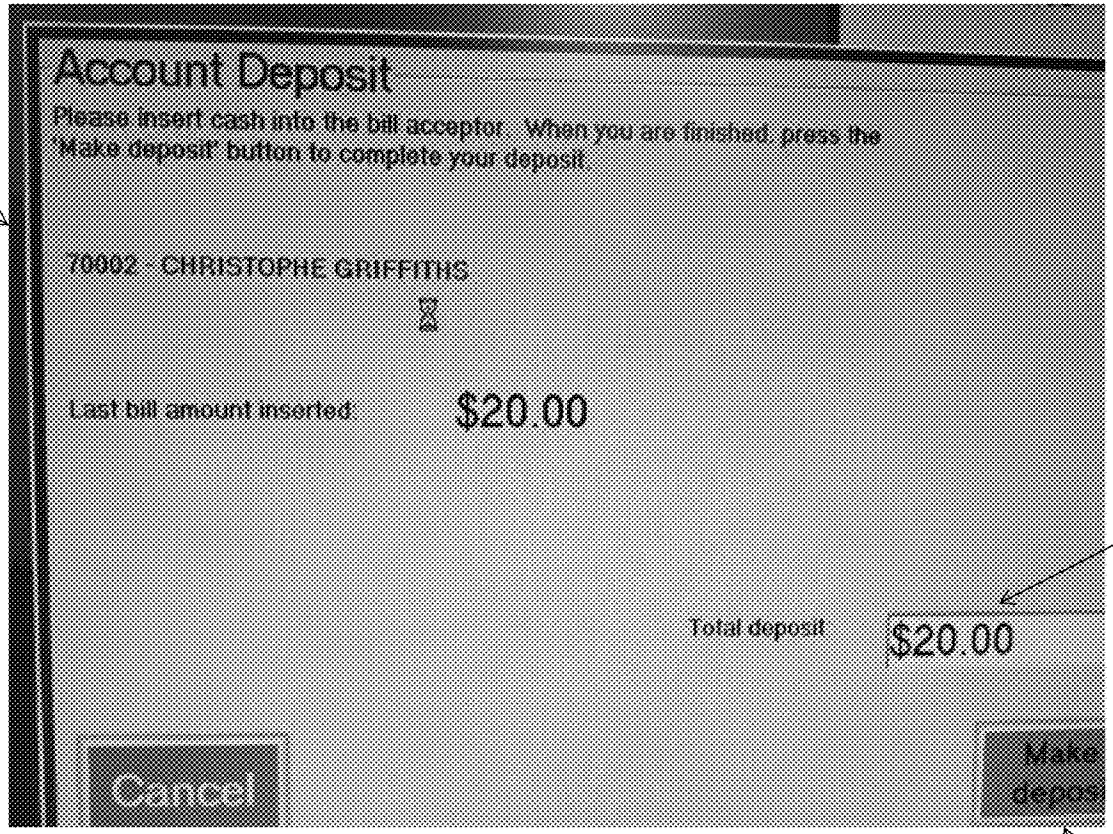

FIGS. 4A-4G illustrate a series of exemplary screen shots of a deposit process associated with the kiosk according to the embodiments of the present invention. FIG. 4A shows a screen shot 401 depicting a touch screen keypad 410 for the player to enter an account ID; FIG. 4B shows a screen shot 402 depicting an account ID 415 being entered; FIG. 4C shows a screen shot 403 depicting password 420 being entered; FIG. 4D shows a screen shot 404 depicting an action interface for a player to select a desired action along with a current account balance 425; FIG. 4E shows a screen shot 405 depicting a deposit interface 430 or withdraw interface 435; FIG. 4F shows a screen shot 406 depicting a deposit amount 440 and deposit icon 445; and FIG. 4G shows a screen shot 407 depicting a deposit amount 450 and deposit icon 455.

Figure 5A:
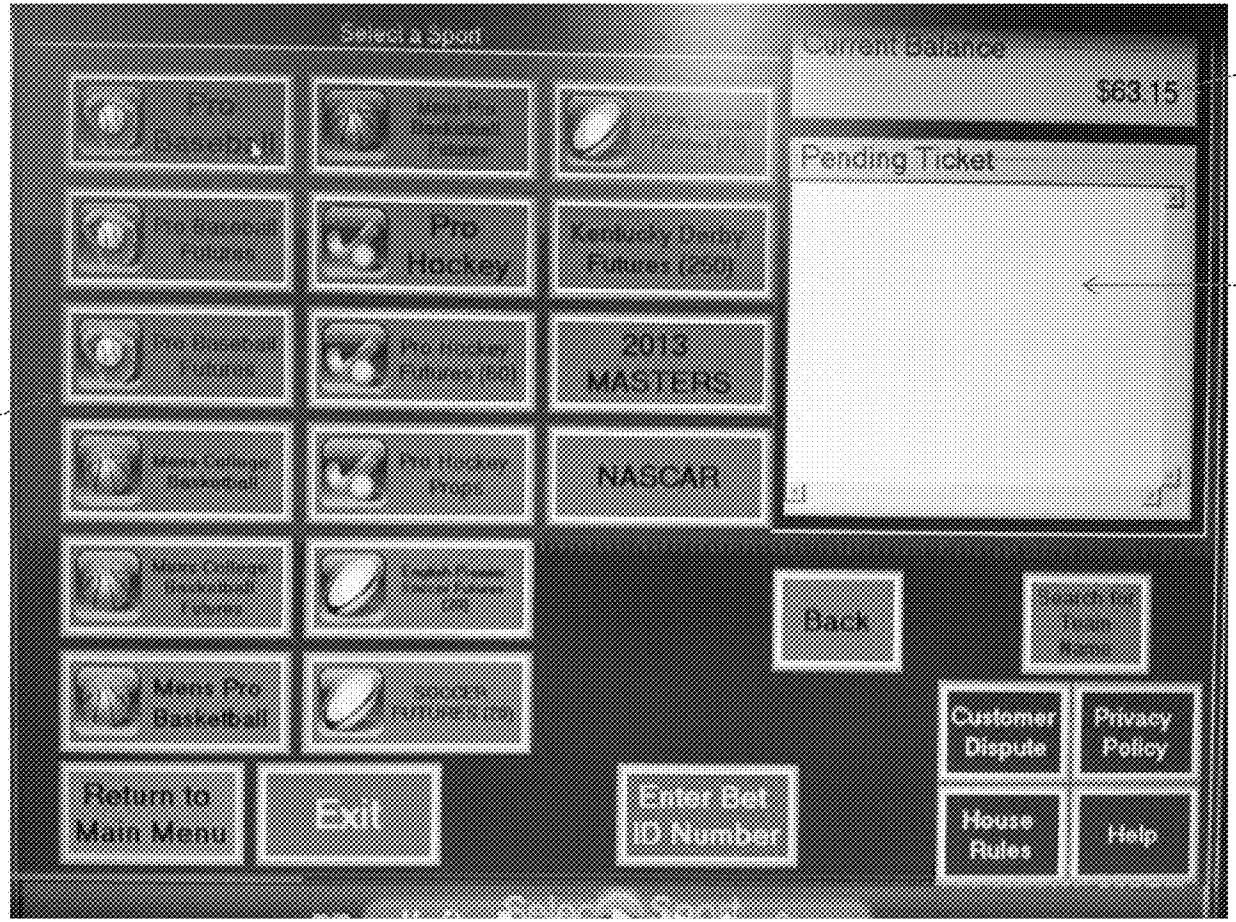
FIGS. 5A-5D illustrate a series of exemplary screen shots of a wager process associated with the kiosk according to the embodiments of the present invention.
Figure 5B:
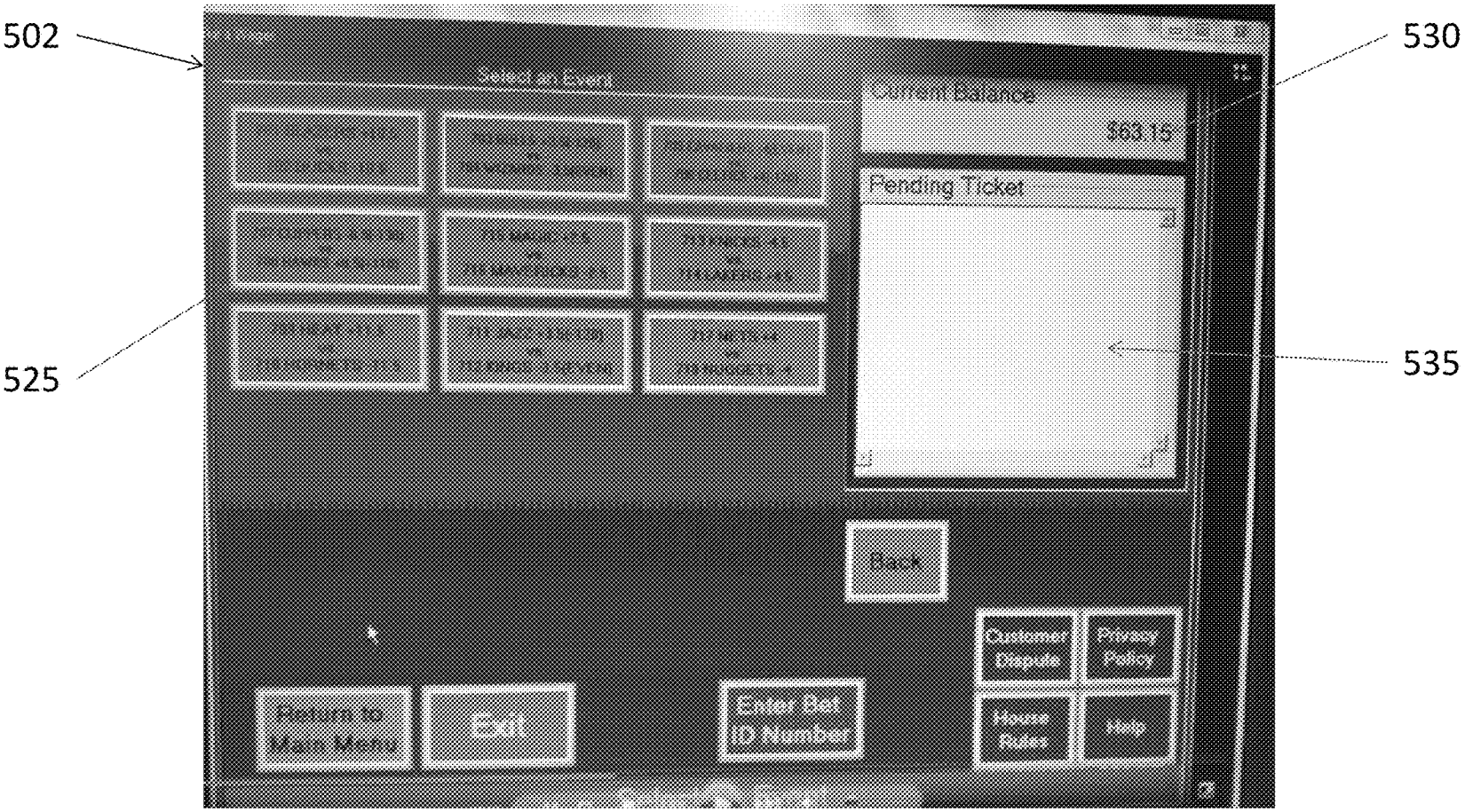
Figure 5C:
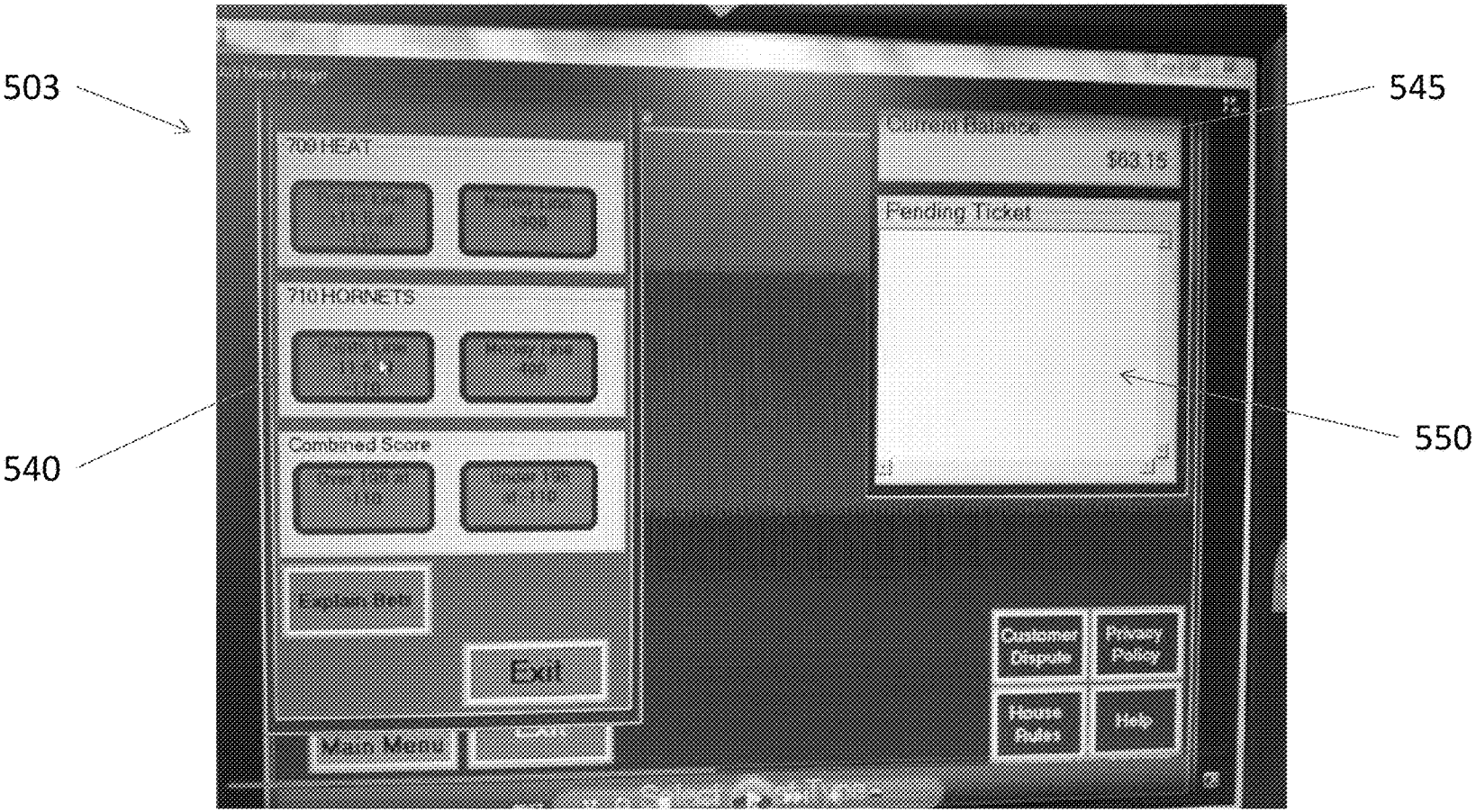
Figure 5D:
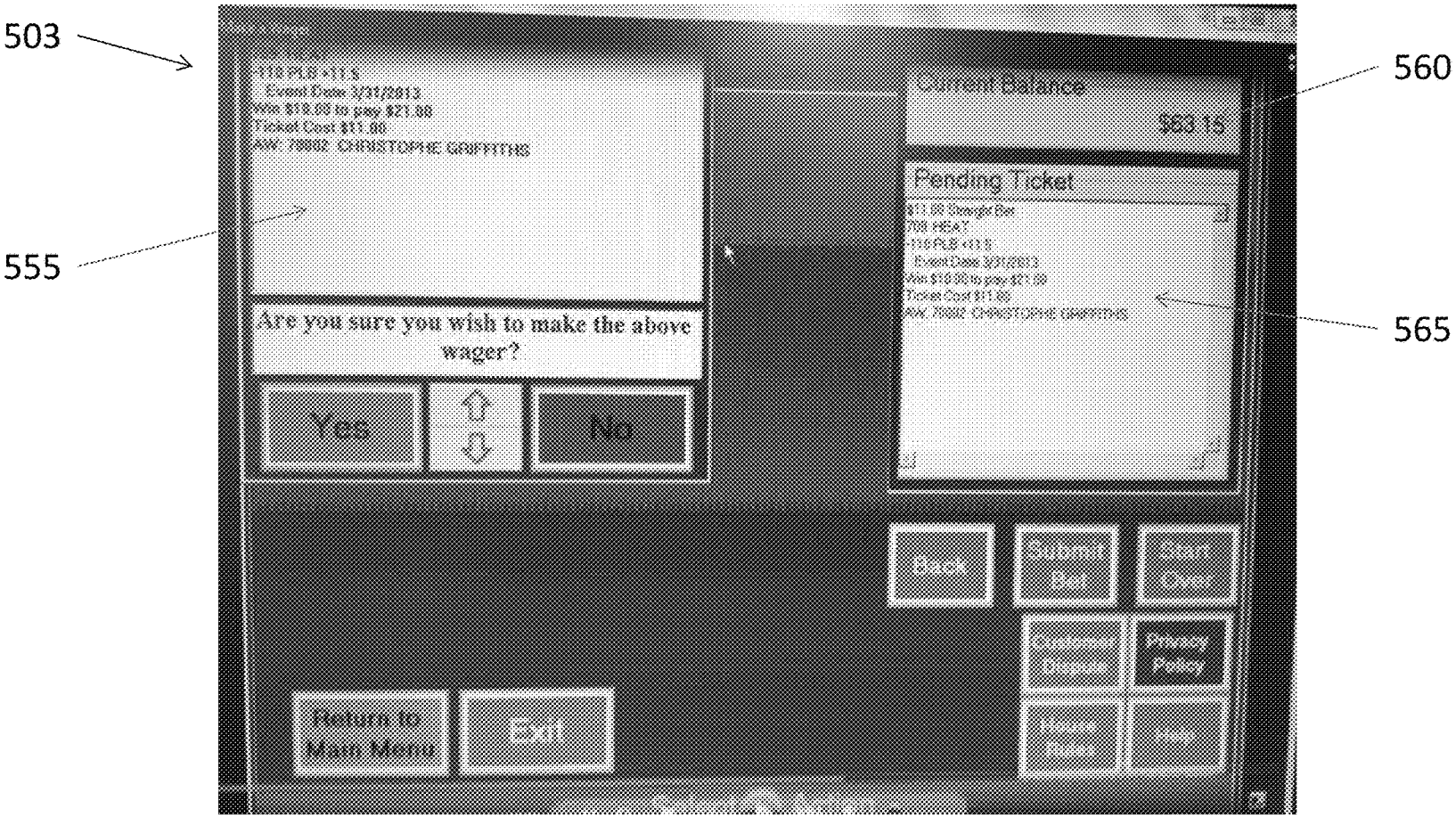

FIGS. 5A-5D illustrate a series of exemplary screen shots of a wager process associated with the kiosk according to the embodiments of the present invention. FIG. 5A shows a screen shot 501 depicting a sport-selection interface 510, account balance 515 and pending ticket window 520; FIG. 5B shows a screen shot 502 depicting a wager-selection interface 525 of possible NBA wagers, account balance 530 and pending ticket window 535; FIG. 5C shows a screen shot 503 depicting a wager-selection interface 540 of specific NBA team wagers, account balance 545 and pending ticket window 550; and FIG. 5D shows a screen shot 504 depicting a wager confirmation interface 555, account balance 560 and pending ticket window 565. The pending ticket window 565 shows the particulars of the entered wager.

Figure 6A:
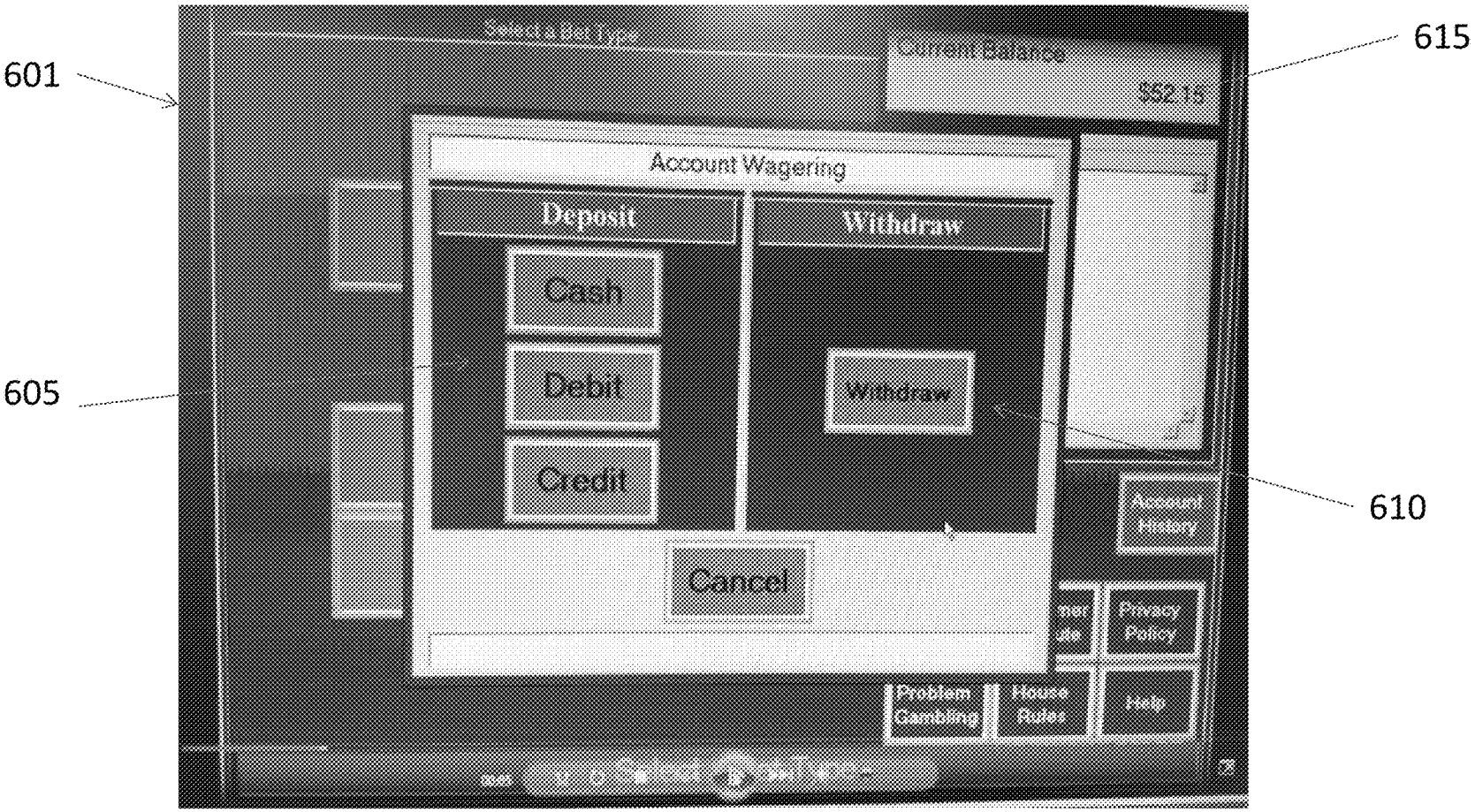
FIGS. 6A-6C illustrate a series of exemplary screen shots of a withdraw process associated with the kiosk according to the embodiments of the present invention.
Figure 6B:
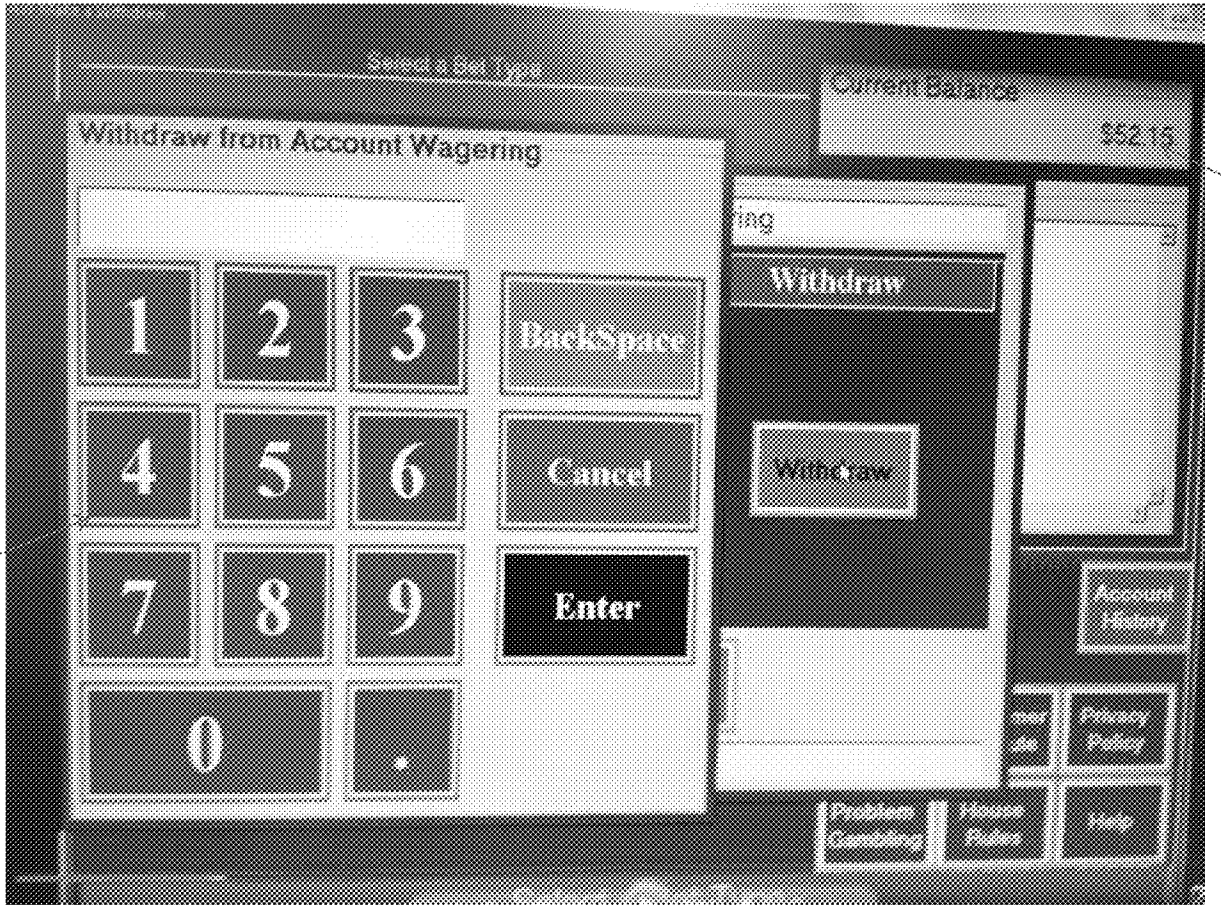
Figure 6C:
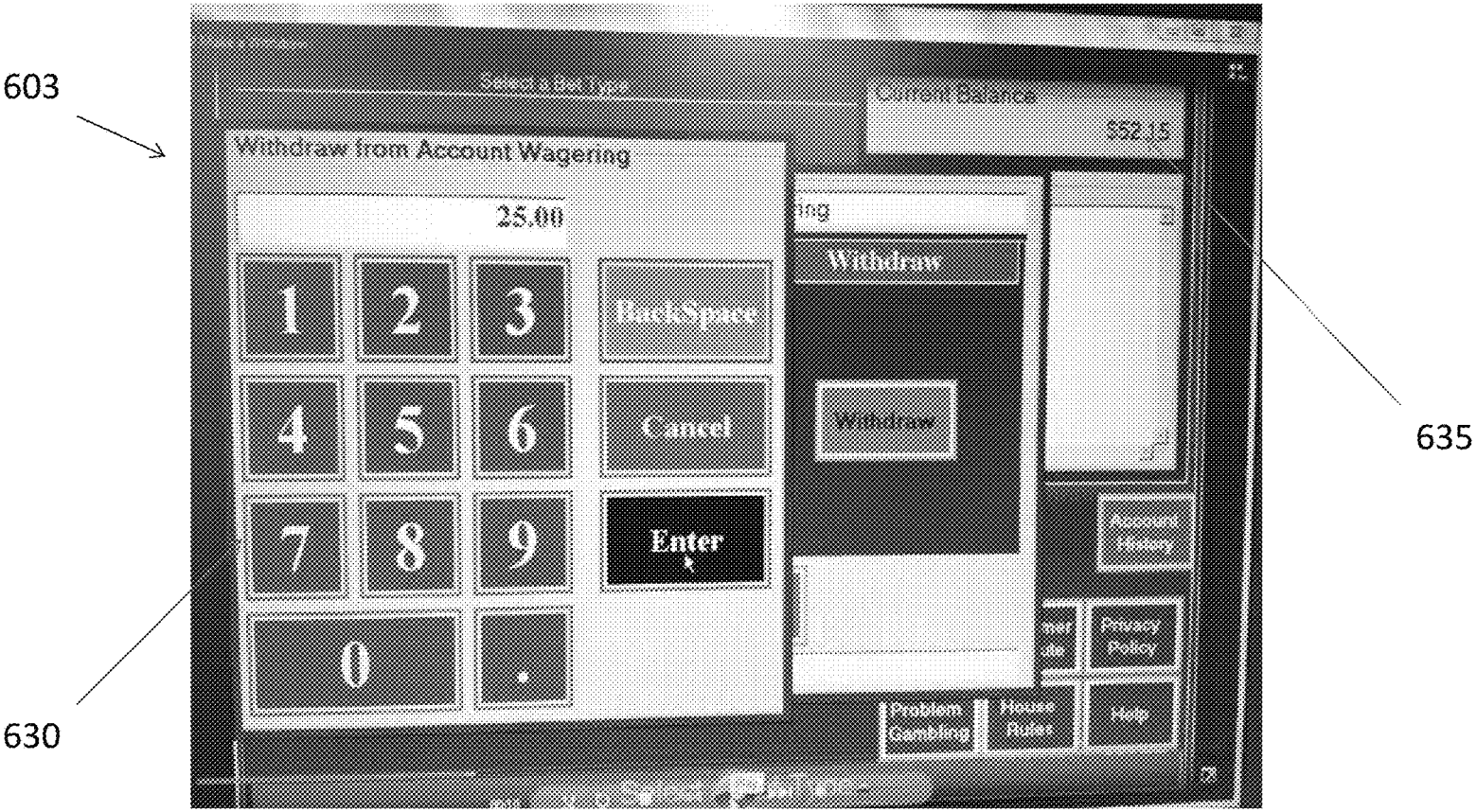
Figure 7A:
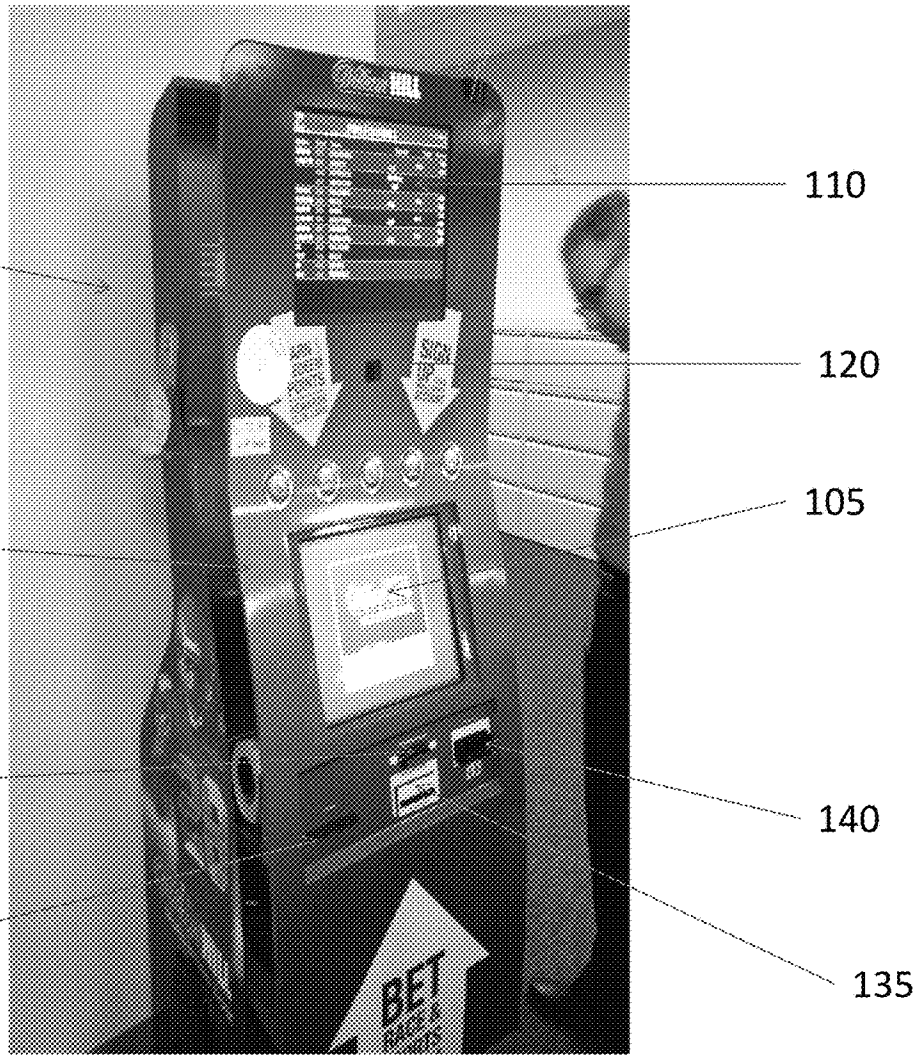
FIGS. 7A-7F illustrate an exemplary kiosk housing which may be used to facilitate the embodiments of the present invention.
Figure 7B:
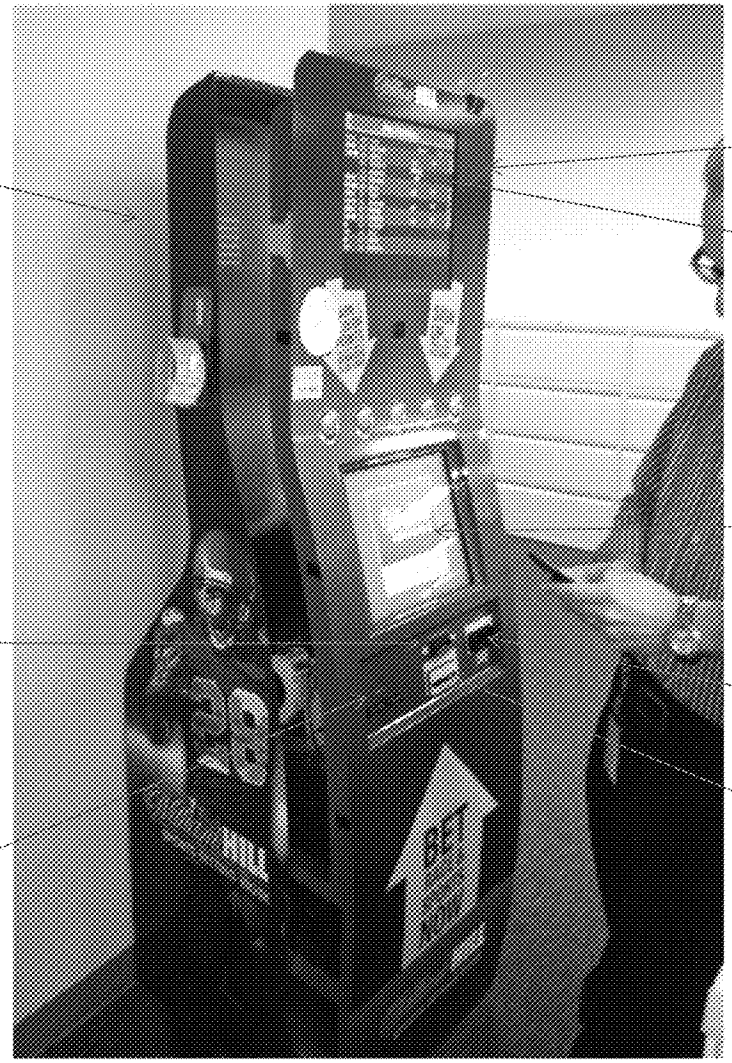
Figure 7C:
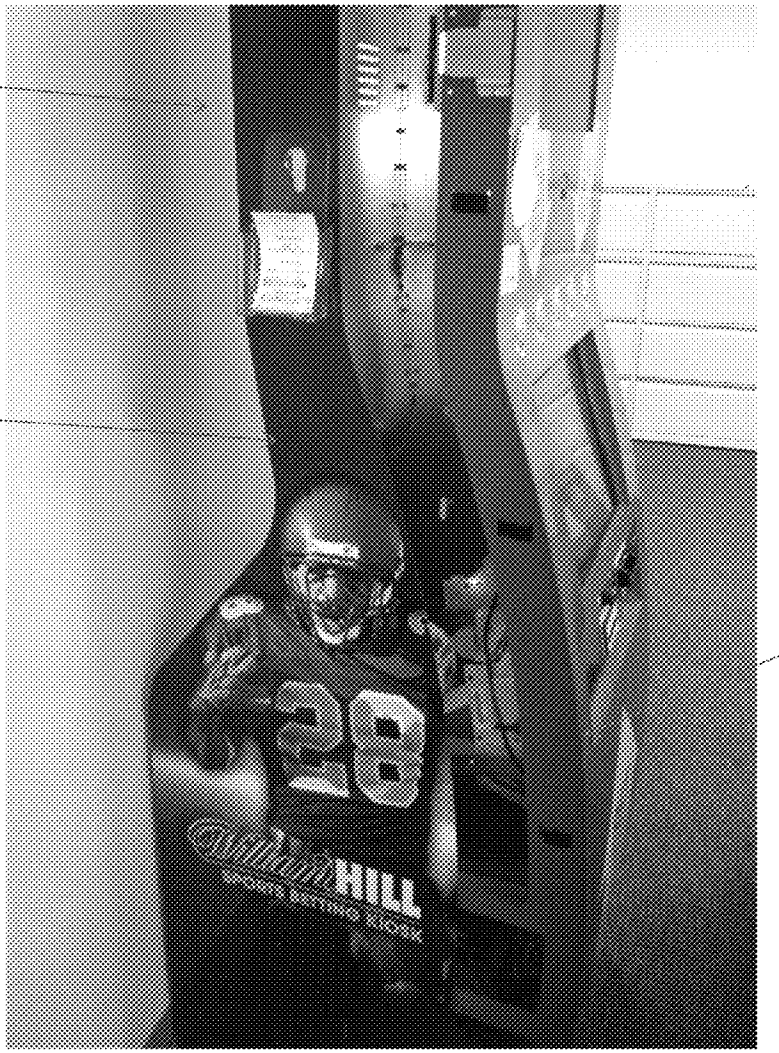
Figure 7D:
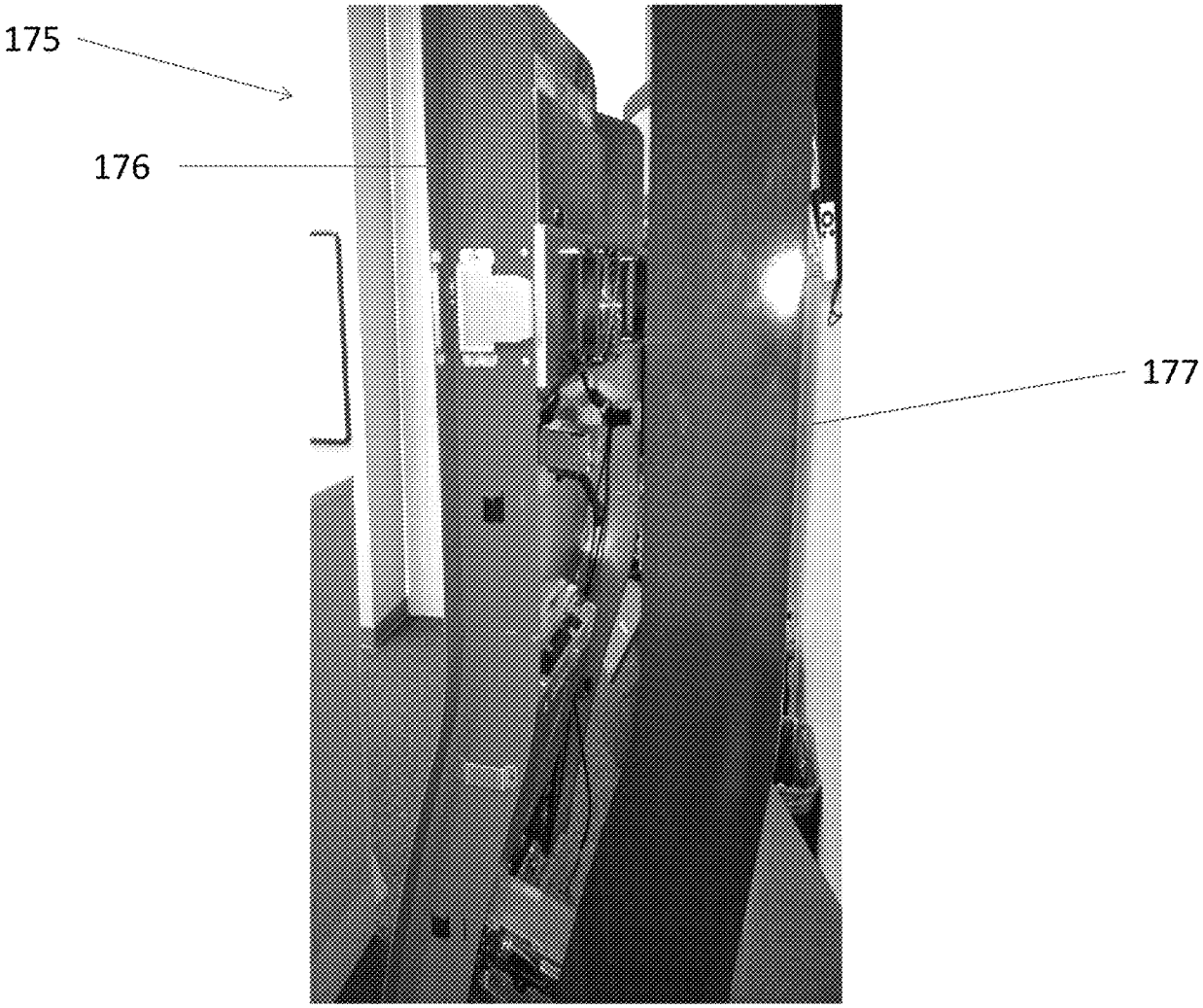
Figure 7E:
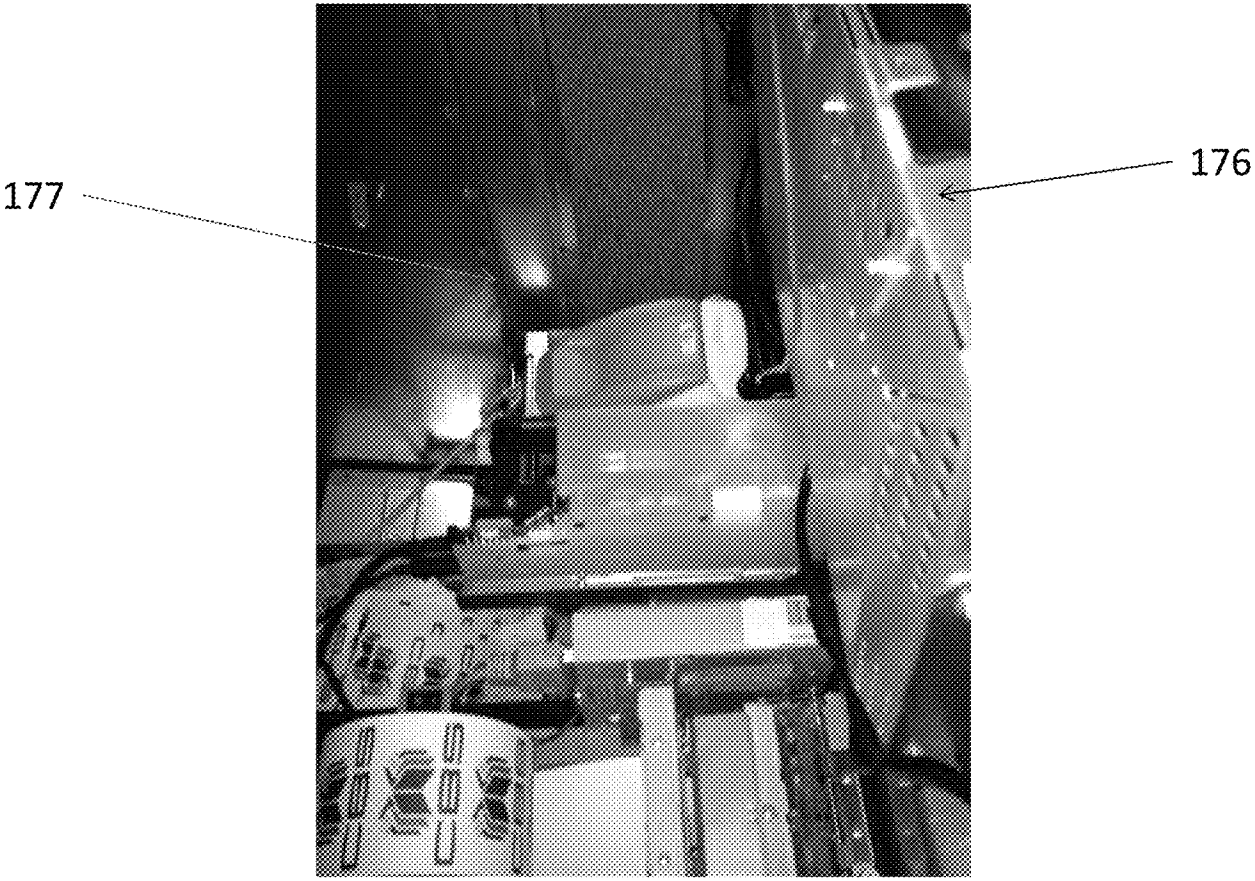
Figure 7F:
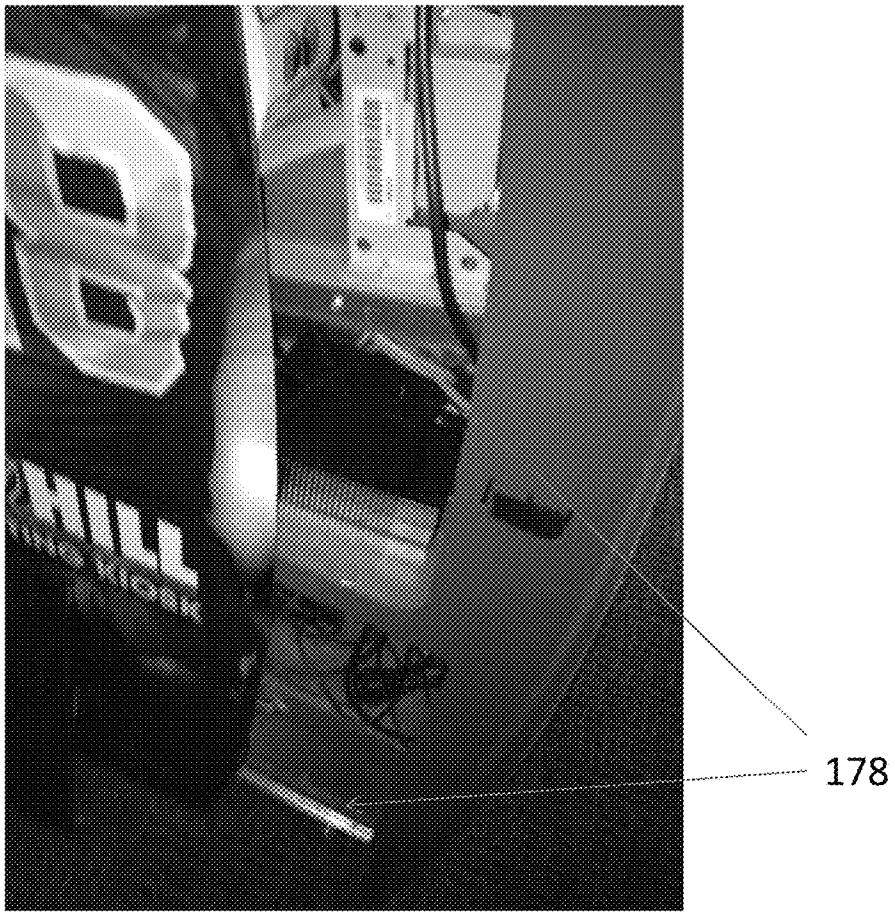

FIGS. 6A-6C illustrate a series of exemplary screen shots of a withdraw process associated with the kiosk according to the embodiments of the present invention. FIG. 6A shows a screen shot 601 depicting a deposit interface 605, withdraw interface 610 and current account balance 615; FIG. 6B shows a screen shot 602 depicting a withdraw keypad 620 and current account balance 625; and FIG. 6C shows a screen shot 603 depicting a withdraw keypad 630 with $25 being withdrawn and current account balance 635.

Although the invention has been described in detail with reference to several embodiments, additional variations and modifications exist within the scope and spirit of the invention as described and defined in the following claims.

We claim:

1. A sports-wagering device comprising:

a ticket/voucher validator;

a user interface;

card reader configured to read photo identification cards;

camera; and a processor programmed to run executable instructions, said executable instructions causing said processor to perform operations comprising:

(i) collection of information from a photo identification card via said card reader;

(ii) verification, by said processor, that said photo identification card is valid;

(iii) verification, by said processor, that a prospective player associated with said photo identification card is of an appropriate age;

(iv) capture a first live picture of said prospective player via said camera;

(v) determine, by said processor, whether a second live picture is required based upon an image quality associated with said first live picture;

(vi) receiving a verification, by said processor, that said photo from said photo identification card and at least one of said first live picture and said second live picture are a match;

(vii) storing, by said processor, said information from said photo identification card and at least one of said first live picture and said second live picture only in response to said verification that said photo from said photo identification card and at least one of said first live picture and said second live picture are a match;

(viii) acceptance of an account password by said prospective player via said user interface; and (ix) registration, by said processor, of said prospective player.

2. The sports-wagering device of claim 1 further comprising a communication link configured to communicate with a central computer system.

3. The sports-wagering device of claim 1 wherein said central computer system comprising one or more servers and one or more terminals linked thereto.

4. The sports-wagering device of claim 1 further comprising an information display for presenting sports-wagering information.

5. The sports-wagering device of claim 1 further comprising a printer.

6. The sports-wagering device of claim 5 wherein said processor is further programmed to run executable instructions for causing account details to be printed on a receipt.

7. The sports-wagering device of claim 1 wherein said processor is further programmed to run executable instructions for at least one of the following: (i) accepting a wager; (ii) depositing money into a wagering account; and/or (iii) withdrawing money vouchers from a wagering account.

8. The sports-wagering device of claim 2 wherein said central computer system includes a computer and one or more terminals in communication therewith.

9. A method of registering prospective players via a kiosk to place sports wagers comprising:

(i) via a card reader, collecting information from a photo identification card of the prospective player;

(ii) via a processor, verifying that said photo identification card is valid;

(iii) via said processor, verifying that said prospective player associated with said photo identification card is of an appropriate age;

(iv) via a camera, capturing a first live picture of a prospective player;

(v) via said processor, determining whether a second live picture is required based upon an image quality associated with said first live picture;

(vi) via said processor, receiving a verification that said photo from said photo identification card and at least one of said first live picture and said second live picture are a match;

(vii) via said processor, storing said information from said photo identification card and at least one of said first live picture and said second live picture only in response to said verification that said photo from said photo identification card and at least one of said first live picture and said second live picture are a match;

(viii) via a user interface, accepting input of account password by said prospective player; and (ix) upon verification, that said photo identification is valid, said prospective player is of an appropriate age and accepting said account password, registering said prospective player.

10. The method of registering prospective players via a kiosk to place sports wagers of claim 9 further comprising communicating with a central computer system.

11. The method of registering prospective players via a kiosk to place sports wagers of claim 9 further comprising presenting sports-wagering information via display.

12. The method of registering prospective players via a kiosk to place sports wagers of claim 9 further comprising printing account details on a receipt.

13. The method of registering prospective players via a kiosk to place sports wagers of claim 9 further comprising utilizing human interaction to verify that said photo from said photo identification card and live picture are a match.

14. The method of registering prospective players via a kiosk to place sports wagers of claim 9 further comprising configuring said kiosk to permit said player to: (i) place a wager; (ii) deposit money into a wagering account; and/or (iii) withdraw money vouchers from a wagering account.

15. A sports-wagering network of kiosks comprising:

a plurality of kiosks configured to facilitate sports wagers, each of said kiosks including at least:

a ticket/voucher validator;

a user interface;

a card reader configured to read photo identification cards;

camera;

a processor; and a central computer system in communication with said plurality of kiosks, said central computer system including one or more servers and one or more terminals linked to said one or more servers;

wherein said plurality of kiosks and one or more servers are configured to:

(i) collect information from a photo identification card via said card reader;

(ii) verify that said photo identification card is valid;

(iii) verify that a prospective player associated with said photo identification card is of an appropriate age;

(iv) capture a first live picture of said prospective player via said camera;

(v) determine whether a second live picture is required based upon an image quality associated with said first live picture;

(vi) receive a verification that said photo from said photo identification card and at least one of said first live picture and said second live picture are a match;

(vii) store said information from said photo identification card and at least one of said first live picture and said second live picture only in response to said verification that said photo from said photo identification card and at least one of said first live picture and said second live picture are a match;

(viii) accept an account password input by said prospective player via said interface; and (ix) register said prospective player.

16. The sports-wagering kiosk of claim 15 wherein each sports-wagering kiosk further comprises an information display for presenting sports-wagering information.

17. The sports-wagering kiosk of claim 15 wherein each sports-wagering kiosk further comprises a printer.

18. The sports-wagering kiosk of claim 15 wherein each sports-wagering kiosk is configured to: (i) accept a wager; (ii) accept deposit money into a wagering account; and/or (iii) permit money vouchers to be withdrawn from a wagering account.

* * * * *